US011729559B2

(12) United States Patent
Sennaroglu et al.

(10) Patent No.: US 11,729,559 B2
(45) Date of Patent: Aug. 15, 2023

(54) HEARING AID WITH HIDDEN USE FEATURE

(71) Applicant: HACETTEPE UNIVERSITESI, Ankara (TR)

(72) Inventors: Levent Sennaroglu, Ankara (TR); Munir Demir Bajin, Ankara (TR); Onur Ergun, Ankara (TR); Bilsay Sumer, Ankara (TR); Harun Artuner, Ankara (TR); Cenk Toker, Ankara (TR); Dincer Gokcen, Ankara (TR); Mehmet Ali Onur, Ankara (TR); Nilay Bereli, Ankara (TR); Adil Denizli, Ankara (TR); Gonca Sennaroglu, Ankara (TR); Merve Batuk, Ankara (TR)

(73) Assignee: HACETTEPE UNIVERSITESI, Ankara (TR)

( * ) Notice: Subject to any disclaimer, the term of this patent is extended or adjusted under 35 U.S.C. 154(b) by 316 days.

(21) Appl. No.: 17/298,632

(22) PCT Filed: May 13, 2020

(86) PCT No.: PCT/TR2020/050419
§ 371 (c)(1),
(2) Date: May 31, 2021

(87) PCT Pub. No.: WO2020/236113
PCT Pub. Date: Nov. 26, 2020

(65) Prior Publication Data

US 2022/0053275 A1 Feb. 17, 2022

(51) Int. Cl.
*H04R 25/00* (2006.01)

(52) U.S. Cl.
CPC ..... *H04R 25/556* (2013.01); *H04R 25/554* (2013.01); *H04R 25/606* (2013.01); *H04R 2225/51* (2013.01)

(58) Field of Classification Search
CPC ..... H04R 2225/51; H04R 2225/67; H04R 25/554; H04R 25/556; H04R 25/606
USPC ..... 381/315
See application file for complete search history.

(56) References Cited

U.S. PATENT DOCUMENTS

2005/0159791 A1* 7/2005 Daly ..... A61N 1/36038 607/57
2009/0254163 A1* 10/2009 Gibson ..... A61N 1/0541 607/116

FOREIGN PATENT DOCUMENTS

EP 2853289 A1 * 4/2015 ..... A61N 1/37223
WO WO-2020236113 A1 * 11/2020 ..... H04R 25/554
WO WO-2022103377 A1 * 5/2022
WO WO-2022108553 A1 * 5/2022

* cited by examiner

*Primary Examiner* — Phylesha Dabney
(74) *Attorney, Agent, or Firm* — LADAS & PARRY LLP

(57) ABSTRACT

The present invention relates to a hearing aid (1) which is inserted to body by surgery in order to enable patients with very advanced and total sensorineural hearing loss to detect sounds, stimulate cochlea or any point on the auditory pathway electrically according to the audio information received from external environment, can also be used without its external part, and parts of which can be replaced without being completely removed from the body in case of a malfunction.

23 Claims, 3 Drawing Sheets

HEARING AID WITH HIDDEN USE FEATURE

RELATED APPLICATION

This application is an application under 35 U.S.C. 371 of International Application No. PCT/TR2020/050419 filed on 13 MAY 2020, which claims priority from Turkish Application 2019/07809 filed 23 May 2019, the disclosures of which are incorporated in their entirety by reference herein.

TECHNICAL FIELD

The present invention relates to a hearing aid which is inserted to body by surgery in order to enable patients with very advanced and total sensorineural hearing loss to detect sounds, stimulate cochlea or any point on the auditory pathway electrically according to the audio information received from external environment, can also be used without its external part, and parts of which can be replaced without being completely removed from the body in case of malfunction.

BACKGROUND OF THE INVENTION

Hearing aids which are used in patients with very advanced or total sensorineural hearing loss and inserted to body, stimulate the inner ear or the neural structures on the auditory pathway via electrical stimulations by converting sound information into electrical stimulations. Cochlear implant (CI), brainstem implant, or midbrain implant systems can be given as an example for these devices.

Although there may be a number of software and hardware differences among CI systems being currently used (conventional), their forms of operation and general designs are quite alike. Two basic subunits serve in the operating system of a CI system. These subunits are separated into two units, namely external and internal units. The external unit essentially consists of microphone, battery, processor, transmitting antenna and magnet. Whereas the internal unit contains receiving antenna, magnet, receiving/stimulating electronic module, grounding electrode and electrode array.

The internal unit is the piece which is inserted by implant surgery. This internal unit generally consists of electronic components included in a hermetic box; receiver antenna, magnet outside the box; and electrode array entering the cochlea. The piece consisting of the receiver antenna, the magnet and the hermetic box are inserted to the outer surface (implant bed) of the temporal bone squamous part, under skin and soft tissues by surgery. Upon exiting the implant bed, the electrode array enters the mastoidectomy cavity after proceeding on the temporal bone squamous part. It reaches the middle ear by means of the facial recess after passing through the mastoid cavity and enters the cochlea through the round window. Each conductor in the electrode array terminates with an electrode surface. Except the electrode surface, all parts of the internal unit are covered with a biocompatible insulating material.

In order that an internal part is less affected by impacts, precautions are taken today such as designing a hermetic box such that it will protect contents thereof from impact as well, covering the piece wherein electrode array proceeds on the temporal bone surface with a protective material, and reducing the total thickness of an implant. In addition to these, precautions are taken such as surgically creating an indentation in bone as an implant bed and creating a groove for electrode array. Despite all precautions, device failure due to impacts continues to be a frequent problem.

Fully implantable cochlear implant systems consist of only an internal part. In these systems, receiving antenna and magnet may not be present in the internal part. Instead of these, sound sensor (microphone), power unit and other electronic components included in the external unit may essentially be included in the internal unit and their location sites may be different.

In conventional cochlear implant systems, mechanical sound waves can be received from microphone in the external part or another sound source compatible with the system through the external part by means of electromagnetic waves.

They can have different nomenclatures according to the frequency value of these electromagnetic waves in the frequency spectrum. For example, devices broadcasting at low frequency and high wavelength, FM radio waves or high frequency and low wavelength communication protocols such as Bluetooth or Wi-Fi. The sound sensor located in the external unit detects mechanical sound waves with a certain sampling frequency and sound signals are converted into audio packet in the frequency domain by a sound processor. The transmitting antenna of the external unit is in alignment with the magnet in the middle of the receiving antenna of the internal part by means of the magnet in the middle thereof. Audio packet and electric power received from the battery included in the external unit are transferred by electromagnetic induction from the external part to the internal part between the two opposite antennas. The receiving/stimulating piece of the internal part also operates with the electric power transferred from the external part. According to the incoming audio information, the electronic circuit included in the internal unit creates the stimulation signals to reach the suitable conductors in the electrode array by using current or voltage generators. A separate conductor reaching each electrode is included in the electrode array. Induction transfer does not exist and the system operates by using the audio data it detects since there is a self-energy source and sound receiving assembly in fully implanted cochlear implant systems.

Different stimulation strategies, sound processing solutions and stimulation methods such as unipolar or bipolar stimulation can be preferred in cochlear implant systems. Regardless of the preferred method, it is ultimately required to stimulate the hair cells in the cochlea electrically by the electrode surfaces to generate perception of sound. Even though unipolar excitation wherein grounding electrode is away from cochlea is preferred in many cochlear implants, bipolar excitation wherein electrode surfaces can sometimes serve as grounding and sometimes serve as stimulus can also be preferred.

In order that cochlear implant systems which can operate without external parts to operate, the energy source must be placed in the implanted part. If this energy source is a battery unit with a limited lifetime, battery replacement will be required inevitably after a certain period of time. The fact that battery replacement process is carried out by removing and replacing the whole internal part is not acceptable due to risks such as infection, placement problems it involves.

Activities of design related to reducing the bulging on the skin caused by the implanted piece in CIs are a preferred priority in order to both increase patient satisfaction aesthetically and to ensure that the device is protected from impacts further.

The United States patent document no. U.S. Pat. No. 6,859,666B1 discloses idea of distributing components of a second hermetic box and cochlear implant within mastoidectomy cavity, into two separate boxes; one on the outer surface of the temporal bone squamous part and one within the mastoidectomy cavity by aiming to diminish the dimension of the box in the implant bed, reduce its protrusion outwards and thus reduce both visibility and risk of being affected by impact in traumas.

In conventional cochlear implants, use of external parts is required and the internal part does not operate without the external part. In cases such as malfunction, infection requiring device replacement; it is also necessary to remove the electrode array and replace it together with the device. In these cases, re-insertion may not be complete and the user may not experience the performance s/he has experienced with the new insertion as well. Particularly in the case of a brain stem implant, the brain membrane must be opened in order to remove the electrode array and undesirable conditions such as life risk, meningitis risk, intracranial bleeding may occur depending on the process.

Although the internal part is under the skin in the implant bed in cochlear implants, it protrudes a little from the skin. And this leads to malfunction in case of being exposed to impacts. Particularly, the part where the electrode array proceeds on the surface of the temporal bone before entering the mastoidectomy cavity is sensitive to impacts. At this point, there is a hard cortical bone under the electrode array and in case of receiving impact, very thin electrical conductive wires in thereof may be affected.

Today, in the uses of cochlear implants with two hermetic boxes, boxes one of which remains in the implant bed and the other one remains within the mastoidectomy cavity together with the electrode array are interconnected by means of connection elements that can be cable. From the hermetic boxes; the first unit wherein the box remaining in the implant bed is included and mostly the receiving antenna, the magnet and the grounding electrode are located and the second unit which is located in the mastoidectomy cavity together with the cable and wherein the hermetic box, the electrode array, the electrode surface are included are interconnected by means of cable. Thinning the unit located in the implant bed as mentioned in the United States patent document no.

U.S. Pat. No. 6,859,666B1, to receive impact minimum do not cancel out impacts to be received. Besides, the unit in the implant bed or the cable connecting both units may break down and need to be replaced in cases of no impact as well. Therefore, today there is need for implantable hearing aids wherein at least two separate hermetic boxes one of which is located on the implant bed, and the other one is completely located within the mastoidectomy cavity and at least one surface-contact connector assembly which is detachable between thereof are used. At the same time, there is need for structures whereby the connector connection enabling connection between two boxes will be realized so as to be as close as possible to the second box or on the second box such that it is both not damaged due to impacts and also it will prevent the damaged cable between two boxes from causing to replace the unit being located in the mastoidectomy cavity, which includes the electrode array.

SUMMARY OF THE INVENTION

An objective of the present invention is to realize a hearing aid wherein preferably all of the unit in the implant bed which is the part where risk of impact failure is highest and the cable which is located between two hermetic boxes can be replaced, through a surgical operation, without removing the unit and the electrode array within the mastoidectomy cavity by means of its connector having a detachable structure and two hermetic boxes being located at the ends of the connector.

Another objective of the present invention is to realize a hearing aid wherein connector connection is realized by using contact surface electrodes, and the connector connection is located in the mastoidectomy cavity in order to change all of the cable interconnecting the two units together with the implant bed.

Another objective of the present invention is to realize a hearing aid wherein the connector is located before the hermetic box in the mastoidectomy cavity where the electronic components being responsible for separating the combined audio data into channels are located, thus which connects a lot fewer conductors, and wherein a small and simple connector configuration is used.

Another objective of the present invention is to realize a hearing aid wherein a lot fewer conductors can be used in the cable between two hermetic boxes with the use of a small and simple connector and thus which has thicker and impact-resistant electrical conductors.

Another objective of the present invention is to realize a hearing aid wherein the total thickness in the implant bed is reduced due to the fact that part of the electronic equipment and the connector are contained within the mastoidectomy cavity.

Another objective of the present invention is to realize a subcutaneous hearing aid which enables hidden use by means of integrated energy supply and remote data transfer for certain periods of time.

Another objective of the present invention is to realize a hearing aid which has a structure wherein replacement is facilitated by means of a connector system when battery is used as energy source, in case of in case of capacity loss and experiencing similar problems, or when it is required to renew or update the hardware being used in the wireless data transfer system.

Another objective of the present invention is to realize a hearing aid which can be used for a certain period of time without an external part and gives users the chance to use it hiddenly, by means of its integrated energy and wireless data transfer system.

Another objective of the present invention is to realize a hearing aid which enables to adjust information about the charge condition of the cochlear implant, its remaining time for hidden usage and volume control by interacting with the smartphone of the user or his/her relative by means of its wireless connection independently of the external part.

DETAILED DESCRIPTION OF THE INVENTION

"A Hearing Aid Suitable for Hidden Use" realized to fulfil the objective of the present invention is shown in the figures attached, in which.

Figure 1:
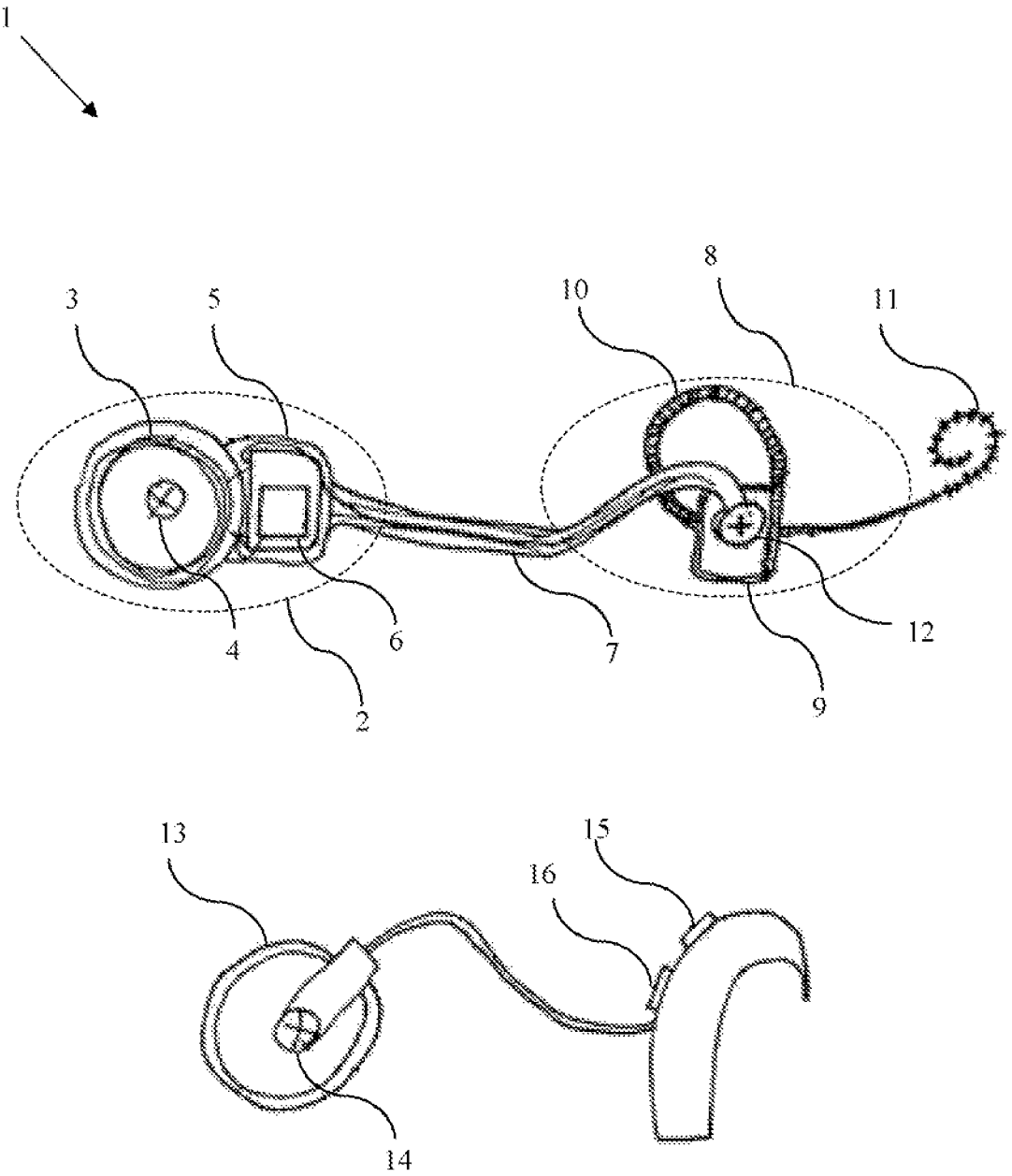
FIG. 1 is a view of the internal and external part in the inventive hearing aid.
Figure 2:
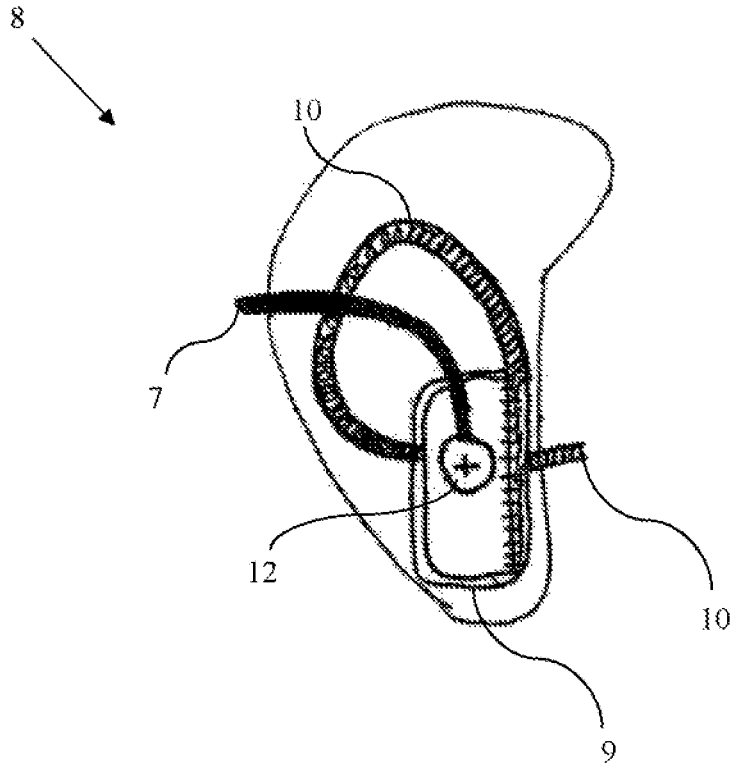
FIG. 2 is a detailed view of the second unit in the inventive hearing aid.
Figure 3:
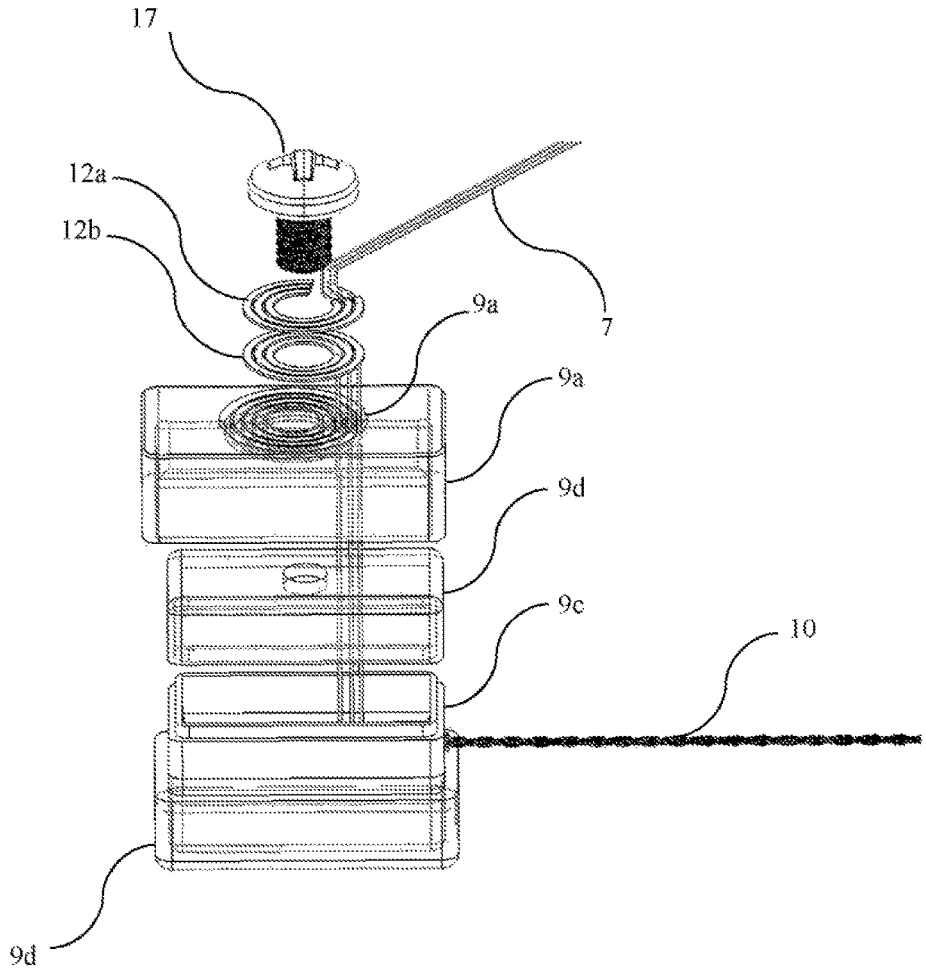
FIG. 3 is a detailed view of the connector included in the inventive hearing aid.

The components illustrated in the figures are individually numbered, where the numbers refer to the following:

1. Hearing aid
2. First unit
3. Receiving antenna

4. Internal magnet
5. First hermetic box
6. Grounding electrode
7. Connection element (cable)
8. Second unit
9. Second hermetic box
9*a*. Electrode housing
9*b*. Upper part
9*c*. Lower part
9*d*. Elastomer
10. Electrode array
11. Electrode contact surface
12. Connector
12*a*. Upper contact electrode
12*b*. Lower contact electrode
13. Transmitting antenna
14. External magnet
15. Power button
16. Connection button
17. Connection piece The inventive hearing aid suitable for hidden use (1) comprises:

at least one first unit (2) which is inserted to the implant bed (outer surface of the temporal bone squamous part) inside the ear; has at least one receiving antenna (3) that receives audio data, at least one internal magnet (4); at least one first hermetic box (5) that receives audio data from the receiving antenna (3) and keeps these in the form of combined audio data and at least one grounding electrode (6) that is located on the first hermetic box (5), at least one energy supplying assembly and at least one wireless connection assembly;

at least one connection element (7) which is connected to the first hermetic box (5) from one end thereof;

at least one second unit (8) which is inserted to the mastoidectomy cavity inside the ear, creates the internal part together with the first unit (2) and the connection element (7); has at least one second hermetic box (9) that has components to distribute combined audio data into separate channels and a connection surface, at least one electrode array (10) wherein the conductors exiting the second hermetic box (9) exist together, at least one electrode contact surface (11) that are conductors composing the electrode array (10), and at least one connector (12) that provides the connection between the first hermetic box (5) and the second hermetic box (9), contacts the connection element (7) from one end thereof and to the connection surface on the second hermetic box (9) from the other end thereof;

at least one transmitting antenna (13) which is in interaction to transmit audio data to the receiving antenna (6) in the first unit (4);

at least one external magnet (14) which provides connection with the internal magnet (4) in the first unit (2), is located outside the body;

at least one power button (15) which is used for controlling the power required for operation, triggered by the user; and at least one connection button (16) which is used for controlling the wireless connection.

In the inventive hearing aid (1), the connector (12) is located in a position close to the second hermetic box (9), such that it will be within the mastoidectomy cavity and have a detachable structure, in case of any failure has a condition that it is sufficient to leave the undamaged electrode array (10) inside the inner ear. Thereby, a subcutaneous hearing aid (1) which enables hidden use by means of integrated energy supply and remote data transfer for certain periods of time is obtained by enabling to remove the connection element (7) by the connector (12) easily, together with the first unit (2) in the inner air bed where the first hermetic box (5) is located.

In a preferred embodiment of the invention, the connector (12) has a detachable structure and it is located between the first and second hermetic box (5, 9). Thereby, a hearing aid (1) wherein all of the first unit (2) in the implant bed which is the part with the highest risk of failure by impact and a pre-determined amount of the connection element (7) located between the two boxes (5, 9) can be changed through a simple surgical operation without removing the second unit (9) and the electrode array (10) within the mastoidectomy cavity, is obtained.

In the inventive hearing aid (1), the connector (12) connection of the connection element (7)—which is preferably electrical wires- to the second hermetic box (9) has a contact surface. In a preferred embodiment of the invention, the connector (12) is located on the second hermetic box (9) and has a detachable structure. In another preferred embodiment, the connector (12) has a structure detachable to the connection element (7) extending out from the second hermetic box (9) such that it will remain within the mastoidectomy cavity. Thereby, length (7) of the connection element (7) desired to be changed can be adjusted by adjusting the position of the connector (12) within the mastoidectomy cavity such that it will be on the second hermetic box (9) or at a desired distance from the second hermetic box (9).

In a preferred embodiment of the inventive hearing aid (1), the connector (12) is located on the outward facing surface of the second hermetic box (9) within the mastoidectomy cavity and contains a connection hole in the middle of the connector (12) contact surfaces. The connector (12) brings the connector contact surfaces on the second hermetic box (9) into correct alignment with connector connection surfaces upon a connection piece (17) passes through the connection holes. The connector (12) is fixed to the wall of the second hermetic box (9) upon the connection piece (17) is tightened. The connection piece (17) does not disrupt the sealing because it does not pass the material on the wall of the second hermetic box (9) entirely. In a preferred embodiment, the connection piece (17) is a screw and the connection hole is a screw hole.

In a preferred embodiment, the connector (12) comprises at least one upper contact electrode (12*a*) which is continuation of the connection element (7) and at least one lower contact electrode (12*b*) which is independent of the upper contact electrode (12*a*) but in contact with the upper contact electrode (12*a*). The lower contact electrode (12*b*) fits into an electrode housing (9*a*) located on the second hermetic box (9). A plurality of conducting wires are located between the lower contact electrode (12*b*) and the electrode array (10). By tightening the connector (12) with a screw, the upper contact electrode (12*a*) and the lower contact electrode (12*b*) are fixed on the second hermetic box (9) over the electrode housing (9*a*).

The second hermetic box (9) wherein the connector (12) is fixed consists of two parts, namely an upper part (9*b*) and a lower part (9*c*). Besides, there are two elastomers (9*d*) such that they will be between the upper part (9*b*) and the lower part (9*c*) and on the lower part of the lower part (9*c*). Thereby, the long-term durability of the second hermetic box (9) is increased.

In a preferred embodiment of the inventive hearing aid (1), the head part of the connector (17) is wide enough to cover the surfaces of the connector (12). The connector (12)

surfaces have grooves and protrusions so as to interlock when the connection piece (17) is tightened and provide sealing like a gasket. The coating material which is located on the surface of the connector (12) and shapes the connector (12) is preferably same as the connection element (7) material. In a preferred embodiment, the connector (12) and the connection element (7) are produced together. The coating material of the connector connection surface on the second hermetic box (9) wall is same as the coating material enclosing the second hermetic box (9) and the electrode array (10) and they are preferably produced together.

In the inventive hearing aid (1), the contact surface of the connector (12) and the connection surfaces of the second hermetic box (9) that will contact each other upon the connection piece (17) is tightened are in the form of spring. The circular-arc shaped contact surfaces are preferably in the form of continuation of the conductors of the connection element (7) between the two hermetic boxes (5, 9) on the connector (12) surface and the conductors entering the second hermetic box (9) in within the mastoidectomy cavity on the other connector (12) surface, and manufactured from a biocompatible electrically conductive material. Due to the fact that the contacting surfaces are in the form of spring, it is enabled to combine the contact surface of the connector (12) and the connection surface of the second hermetic box (9) with each other at a desired angle. The contact surface of the connector (12) which is in the form of continuation of the conductors entering the second hermetic box (9) can be separated only by removing the connection piece (17) from the wall of the second hermetic box (9). Thereby, the contacting surfaces can be brought into a desired angle In the inventive hearing aid (1), the first unit (2) inserted to the implant bed inside the ear, the second unit (8) inserted to the mastoidectomy cavity inside the ear and the connection element (7) enabling to interconnect the first unit (2) and the second unit (8) by lying between the first unit (2) and the second unit (8) compose the internal part of the hearing aid (1). The transmitting antenna (13), the external magnet (14), the power button (15) and the connection button (16) compose the external part of the hearing aid (1).

In the inventive hearing aid (1), the first unit (2) comprises the receiving antenna (3), the internal magnet (4), the first hermetic box (5), the grounding electrode (6) and also the energy supplying assembly and the wireless connection assembly. The first unit (2) transfers the audio data—processed but not channelled—and the energy to the second hermetic box (9) within the mastoidectomy cavity over the connector (12) by the connection element (7) between the first hermetic box (5) and the second hermetic box (9).

In the inventive hearing aid (1), the first unit (2) can receive the audio data by means of the wireless connection assembly it comprises from a microphone located outside the ear and/or from a separate smart device via wireless transfer when hidden use is requested and/or from an external part comprising one transmitting antenna (13), the external magnet (14) elements when the external part is in integrated wireless connection. One or more wireless communication protocol and hardware commonly used in smart devices such as bluetooth are selected for wireless transmission in the hearing aid (1). The first unit (2) performs the transfer by induction between the internal and the external magnet (4, 14) and/or another wireless transfer method, in the event that it receives the audio data from an external part being inserted to the ear, comprising one transmitting antenna (13), the external magnet (14) elements. In order to improve the quality of the stimulation in the device sending the audio data transmitted to the internal unit (2), one or more of the digital sound processing techniques are used. In the hearing aid (1), it is possible to select the source of sound by means of a smart device whereto the internal unit (2) is connected wirelessly and interventions such as adjusting sound volume and feature are performed.

In the inventive hearing aid (1), the first unit (2) comprises at least one rechargeable energy source and/or at least one assembly that can perform energy harvesting, as an energy supplying assembly. The energy source in the first unit (2) is an energy storage such as battery or supercapacitor. In the first unit (2), the assembly performing energy harvesting is a piezoelectric, thermoelectric, electromagnetic or similar energy generator. In the inventive hearing aid (1), the external part wherein the transmitting antenna (13), the external magnet (14) and preferably the power button (15) and the connection button (16) are included transfers the necessary energy to the first unit (2) and the second unit (8) by induction from an energy source it has while it is inserted to ear. The energy necessary for the first unit (2) and the second unit (8) can be provided by the energy transferred from the external part; the energy supplying assembly located in the first unit (2) is charged—if it is rechargeable—in case of need. If the inventive hearing aid (1) operates when the external part is not inserted, the energy necessary is provided from the energy supplying assembly. In the inventive hearing aid (1), the first unit (2) enables the user to follow up the charging status, the energy source and to make the necessary settings by establishing connection with a smart device wirelessly.

In the inventive hearing aid (1), conductors of the grounding electrode (6) included in the first unit (2) are located in the connection element (7) between the connector (12) and the two hermetic boxes (5, 9).

In a preferred embodiment of the invention, the first hermetic box (5) is located at one end of the connection element (7) whereas the connector (12) connected to the second hermetic box (9) is located at the other end thereof. The connector element (7) is a cable suitable for energy and data transfer. In another preferred embodiment, the connection element (7) enables connection of the connector (12) to the second hermetic box (9) over the connection element (7) by protruding outwards from the second hermetic box (9). Thereby, in case of predicting the part of the connection element (7) which may break down, the connector (12) is inserted at the end of the connection element (7) up to the amount desired to be replaced.

In the inventive hearing aid (1), the second unit (8) within the mastoidectomy cavity consists of the second hermetic box (9), the electrode array (10), the electrode contact surface (11) and the connector (12). Data and energy transfer between the second unit (8) and the first unit (2) is carried out by means of the connection element (7) which is a cable. The second hermetic box (9) included in the second unit (8) creates the stimulation signals to reach the suitable conductors in the electrode array (10) by using the audio data received from the first unit (2) and distributes combined audio data into channels. Thickness of the first unit (2) and number of components are reduced due to the fact that the second hermetic box (9) separates the audio data into channels and creates the stimulation signals by using its structure. Besides, it is enabled to use thicker conductors by reducing the number of the conductors in the connection element (7) located between the second hermetic box (9) and the first hermetic box (5).

The electrode array (10) included in the second unit (8) is generated such that separate conductors, each of which will reach a different electrode contact surface (11), exist together separately after exiting the second hermetic box (9).

The inventive hearing aid (1) is implanted into the ear by means of known surgical techniques. The connector (12) located in the internal part is removed from its package in a sterile and unmounted form and it is implanted without being disassembled. However, after the electrode array (10) is inserted to the cochlea, the second unit (8) is laid into its place such that it will entirely remain inside the mastoidectomy cavity. In the event of any malfunction in the hearing aid (1), since the connector (12) connection is in the second hermetic box (9) within the mastoidectomy cavity, a replacement can be made without removing the second hermetic box (9) and the electrode array (10) if the failure results from the connection element (7) between the first unit (2), the two hermetic boxes (5, 9) or the contact surface of the connector (12) following thereof. The connection piece (17), which can be a screw, in the connector (12) is unscrewed without dislocating the second hermetic box (9) and the electrode array (10) and the contact surface of the movable connector following the connection element (7) is disconnected from the connection surfaces of the second hermetic box (9). The first unit (2), the connection element (7) and the following connector (12) in the implant bed to be replaced are taken out and replaced with a new one. Connection holes of the contact surface of the connector (12) and the connection surface of the second hermetic box (9) are brought into the same alignment and connection of the connector (12) is realized by tightening the connection piece (17) to the wall of the second hermetic box (9). Upon realizing connection of the connector (12), sealing is provided by using liquid silicone that solidifies with ultraviolet light upon or a similar isolation method.

In order that the inventive hearing aid (1) can match with a smart device, the external part must be attached and the wireless connection must be powered on and also the required software or application must be available in the smart device. After the smart device and the hearing aid (1) find each other, the connection is approved by pressing the power button (15) and the connection button (16) located on the external part accordingly. Priority order of the smart devices or sound sources matching with the hearing aid (1) can be changed from any approved smart device, the device settings can be made or priority orders of the sound sources can be changed. If the approved smart device has internet connection, settings of the inventive hearing aid (1) can be made or its information can be accessed by remote access in case of approval.

In order that the inventive hearing aid (1) can operate, the outer part must be attached and the power button (15) located on thereof must be pressed. Upon the inventive hearing aid (1) is switched on, the wireless connection is activated and it automatically connects to the smart device it matches according to the priority order. The hearing aid (1) continues to search for a wireless connection unless the wireless connection is deactivated if no matched smart device can be found while the outer part is attached. The first unit (2) and the second unit (8) included in the internal part primarily use the audio data received from the microphone. It is possible to change the active sound source from the smart device connected even when the outer part is attached. If there is a smart device connected by wireless connection, the active sound source becomes the connected smart device when the external part is removed. It continues to operate on its own even when the outer part is removed and it becomes selectable by the smart device connected as an alternative sound source, in configurations comprising integrated wireless connection system. However the external part closes if it is not selected as a sound source for a certain period of time. Pressing the power button (15) while the external part is removed only affects the external part.

The inventive hearing aid (1) continues to work like a conventional cochlear implant by pressing the power button (15) when the wireless connection is activated and the external part is attached or disconnecting the wireless connection in the event of issuing a command for deactivating the wireless connection by means of an application in the connected smart device. The connection button (16) on the external part attached is pressed when reactivation of the wireless connection is desired in the hearing aid (1). In this case, even if a wireless connection cannot be established, the search continues continuously. If the external part is removed while the hearing aid (1) is operating by the audio data received from the external part such that the wireless connection is switched off, the wireless connection is automatically switched on and if a connection can be established with a previously matched smart device, it starts operating in hidden status. However the hearing aid (1) switches off if wireless connection cannot be established for a certain period of time or there is not enough energy in the energy supplying mechanism in the internal part.

The hearing aid (1) switches off at the stage wherein command for switching off the wireless connection is issued from the application in the smart device connected by the inventive hearing aid (1) while operating in hidden use. Similarly, in applications wherein the external part comprises integrated wireless connection system and performs remote audio data transmission, the hearing aid (1) switches off when the connection button (16) is pressed. However, if the active sound source is another device while the external part is not attached, the connection button (16) in the external part has no function. The hearing aid (1) switches off in the event of pressing the power button (15) while it is operating such that the external part is attached. Because the hearing aid (1) also stops searching for wireless connection when it is switched off, the wireless connection cannot be activated without attaching the external part. However, the hearing aid (1) preferably comprises at least one magnetic contact located on the first unit (2), in order to activate the wireless connection without the external part. The said magnetic contact can be a reed switch or similar assembly.

The inventive hearing aid (1) switches off in the event that the energy supplying assembly cannot provide the necessary energy while it operates in hidden use mode. However, at the stage wherein the external part is attached and operates by the audio data being received from the microphone in the external part and energy of the external part is run out, when there is also enough energy in the energy supplying assembly included in the internal part, the inventive hearing aid (1) starts operating in hidden mode in the case that it is already connected to the smart device. In the same case if the hearing aid (1) remains as the switched-off wireless connection, the wireless connection switches on automatically and starts operating in hidden mode if it can establish connection with a previously matched smart device. But the hearing aid (1) switches off in the event that it cannot establish wireless connection for a certain period of time or there is not enough energy in the energy supplying assembly in the internal part. The hearing aid (1) tries to connect other sound sources according to the priority order in case of disconnection from the sound source being connected while operating in the hidden mode however it switches off if no connection is established for a certain period of time.

Within these basic concepts; it is possible to develop various embodiments of the inventive hearing aid (1); the invention cannot be limited to examples disclosed herein and it is essentially according to claims.

The invention claimed is:

1. A hearing aid (1) comprising at least one first unit (2) which is inserted to the implant bed (outer surface of the temporal bone squamous part) inside the ear; has at least one receiving antenna (3) that receives audio data, at least one internal magnet (4); at least one first hermetic box (5) that receives audio data from the receiving antenna (3) and keeps these in the form of combined audio data and at least one grounding electrode (6) that is located on the first hermetic box (5), at least one energy supplying assembly and at least one wireless connection assembly;

at least one connection element (7) which is connected to the first hermetic box (5) from one end thereof;

at least one second unit (8) which is inserted to the mastoidectomy cavity inside the ear; creates the internal part together with the first unit (2) and the connection element (7); has at least one second hermetic box (9) that has components to distribute combined audio data into separate channels and a connection surface, at least one electrode array (10) wherein the conductors exiting the second hermetic box (9) exist together, at least one electrode contact surface (11) that are conductors composing the electrode array (10), and at least one connector (12) that provides the connection between the first hermetic box (5) and the second hermetic box (9), contacts the connection element (7) from one end thereof and to the connection surface on the second hermetic box (9) from the other end thereof;

at least one transmitting antenna (13) which is in interaction to transmit audio data to the receiving antenna (6) in the first unit (4);

at least one external magnet (14) which provides connection with the internal magnet (4) in the first unit (2), is located outside the body;

at least one power button (15) which is used for controlling the power required for operation, triggered by the user;

at least one connection button (16) which is used for controlling the wireless connection;

characterized by the connector (12) which is located in a position close to the second hermetic box (9), such that it will be within the mastoidectomy cavity and have a detachable structure, in a condition where it is sufficient to leave the electrode array (10) inside the inner ear for troubleshooting in case of any failure.

2. A hearing aid (1) according to claim 1; characterized by the connector (12) which has a detachable structure and is located between the first and second hermetic box (5, 9).

3. A hearing aid (1) according to claim 1; characterized by the connector (12) wherein connection of the connection element (7)—which is electrical wires—to the second hermetic box (9) has a contact surface.

4. A hearing aid (1) according to claim 1, characterized by the connector (12) which is located on the second hermetic box (9) and has a detachable structure.

5. A hearing aid (1) according to claim 1, characterized by the connector (12) which has a structure detachable to the connection element (7) extending out from the second hermetic box (9) such that it will remain within the mastoidectomy cavity.

6. A hearing aid (1) according to claim 1, characterized by the connector (12) which is located on the outward facing surface of the second hermetic box (9) within the mastoidectomy cavity and contains a connection hole in the middle of the connector (12) contact surfaces.

7. A hearing aid (1) according to claim 6; characterized by the connector (12) which brings the connector contact surfaces on the second hermetic box (9) into correct alignment with connector connection surfaces upon a connection piece (17) passes through the connection holes.

8. A hearing aid (1) according to claim 7; characterized by the connector (12) which is fixed to the wall of the second hermetic box (9) upon the connection piece (17) is tightened.

9. A hearing aid (1) according to claim 7; characterized by the connector (12) surfaces of which have grooves and protrusions so as to interlock when the connection piece (17) is tightened and provide sealing like gasket.

10. A hearing aid (1) according to claims 7; characterized by the contact surface of the connector (12) and the connection surfaces of the second hermetic box (9) connector (12), that will contact each other upon the connection piece (17) is tightened, which are in the form of spring.

11. A hearing aid (1) according to claim 10; characterized by the circular-arc shaped contact surfaces which are in the form of continuation of the conductors of the connection element (7) between the two hermetic boxes (5, 9) on the connector (12) surface and the conductors entering the second hermetic box (9) in within the mastoidectomy cavity on the other connector (12) surface, and manufactured from a biocompatible electrically conductive material.

12. A hearing aid (1) according to claim 1, characterized by the first unit (2) which transfers the audio data—processed but not channelled—and the energy to the second hermetic box (9) within the mastoidectomy cavity over the connector (12) by the connection element (7) between the first hermetic box (5) and the second hermetic box (9).

13. A hearing aid (1) according to claim 1, characterized by the first unit (2) which can receive the audio data by means of the wireless connection assembly it comprises from a microphone located outside the ear and/or from a separate smart device via wireless transfer when hidden use is requested and/or from an external part comprising one transmitting antenna (13), the external magnet (14) elements when the external part is in integrated wireless connection.

14. A hearing aid (1) according to claim 13; characterized by the first unit (2) which performs the transfer by induction between the internal and the external magnet (4, 14) and/or another wireless transfer method, in the event that it receives the audio data from an external part being inserted to the ear, comprising one transmitting antenna (13), the external magnet (14) elements.

15. A hearing aid (1) according to claim 1, characterized by the first unit (2) which comprises at least one rechargeable energy source and/or at least one assembly that can perform energy harvesting, as an energy supplying assembly.

16. A hearing aid (1) according to claim 1, characterized by the first unit (2) wherein the energy source is an energy storage such as battery or supercapacitor.

17. A hearing aid (1) according to claim 1, characterized by the first unit (2) wherein the assembly performing energy harvesting is a piezoelectric, thermoelectric, electromagnetic or similar energy generator.

18. A hearing aid (1) according to claim 1, characterized by the external part wherein the transmitting antenna (13), the external magnet (14) and preferably the power button (15) and the connection button (16) are included, which transfers the necessary energy to the first unit (2) and the second unit (8) by induction from an energy source it has while it is inserted to ear.

19. A hearing aid (1) according to claim 1, characterized by the grounding electrode (6) conductors of which are located in the connection element (7) between the connector (12) and the two hermetic boxes (5, 9).

20. A hearing aid (1) according to claim 1, characterized by the connection element (7) wherein the first hermetic box (5) is located at one end thereof whereas the connector (12) connected to the second hermetic box (9) is located at the other end thereof.

21. A hearing aid (1) according to claim 1, characterized by the connection element (7) which is a cable suitable for energy and data transfer.

22. A hearing aid (1) according to claims 1; characterized by the connection element (7) which enables connection of the connector (12) to the second hermetic box (9) over the connection element (7) by protruding outwards from the second hermetic box (9).

23. A hearing aid (1) according to claim 1, characterized by the second hermetic box (9) which creates stimulation signals to reach the suitable conductors in the electrode array (10) by using the audio data received from the first unit (2) and distributes the combined audio data into channels.

* * * * *